US006565123B2

(12) United States Patent
Schiemann et al.

(10) Patent No.: US 6,565,123 B2
(45) Date of Patent: May 20, 2003

(54) LATCH FOR TELESCOPING VACUUM-CLEANER TUBE

(76) Inventors: Jürgen Schiemann, Am Telegraf 1, D-59469 Ense-Höingen (DE); Hartmut Kiel, Ehu 34 A, D-59846 Sundern-Dörnholthausen (DE)

( * ) Notice: Subject to any disclaimer, the term of this patent is extended or adjusted under 35 U.S.C. 154(b) by 0 days.

(21) Appl. No.: 09/995,849

(22) Filed: Nov. 28, 2001

(65) Prior Publication Data

US 2002/0063427 A1 May 30, 2002

(30) Foreign Application Priority Data

Nov. 28, 2000 (DE) ..... 100 59 052

(51) Int. Cl.[7] ..... A47L 9/00; A47L 9/24
(52) U.S. Cl. ..... 285/7; 285/302; 285/303
(58) Field of Search ..... 285/7, 302, 303

(56) References Cited

U.S. PATENT DOCUMENTS

| | | | | |
|---|---|---|---|---|
| 3,351,363 A | * 11/1967 | Downey et al. | ..... | 285/303 |
| 5,941,575 A | 8/1999 | Herbst | | |
| 5,954,370 A | * 9/1999 | Pietersen | ..... | 285/316 |
| 6,148,474 A | * 11/2000 | Ohara et al. | ..... | 15/377 |
| 6,237,962 B1 | * 5/2001 | Lim | ..... | 285/303 |
| 6,354,635 B1 | * 3/2002 | Dyson et al. | ..... | 285/308 |
| 6,431,607 B1 | * 8/2002 | Kittelmann et al. | ..... | 285/303 |
| 2002/0038951 A1 | * 4/2002 | Xu | ..... | 285/7 |

FOREIGN PATENT DOCUMENTS

| | | | | |
|---|---|---|---|---|
| DE | 19524290 | * 7/1995 | | |
| DE | 19528814 | * 8/1995 | | |
| DE | 197 06 210 | 8/1998 | | |
| EP | 520534 | * 6/1992 | | |
| FR | 1224099 | * 6/1960 | ..... | 285/7 |
| GB | 1088640 | * 10/1967 | ..... | 285/7 |
| JP | 6-154138 | * 6/1994 | | |

* cited by examiner

*Primary Examiner*—Eric K. Nicholson
(74) *Attorney, Agent, or Firm*—Herbert Dubno; Andrew Wilford

(57) ABSTRACT

A vacuum-cleaner wand has an inner tube formed with an axially extending row of radially outwardly open recesses, an outer tube, and a latch base part fixed to the outer tube and formed with an elastically deformable web carrying a latching block displaceable radially into and out of the recesses. The base part also is formed with a pair of radially outwardly projecting guide walls forming radially inwardly directed guide edges. A movable latch part fitting over the base part is formed with a pair of radially inwardly projecting guide walls forming radially outwardly directed guide edges sliding on the guide edges of the base part for sliding between axially offset latched and unlatched positions. A radially inwardly projecting actuating bump formed in the movable part bears in the latched position radially inward on the block and holds the block in the inner position.

18 Claims, 11 Drawing Sheets

LATCH FOR TELESCOPING VACUUM-CLEANER TUBE

FIELD OF THE INVENTION

The present invention relates to a vacuum-cleaner tube. More particularly this invention concerns a latch for a telescoping vacuum-cleaner tube.

BACKGROUND OF THE INVENTION

A standard telescoping tube wand for a vacuum cleaner typically as described in German 199 24 451 or copending U.S. patent application Ser. No. 09/578,600 filed May 25, 2000 now U.S. Pat. No. 6,431,607 has an outer tube, an inner tube telescopingly received in the outer tube and provided with an axially extending row of detent recesses, and a latch on the outer tube for relatively axially fixing the inner and outer tubes. The latch has a sleeve surrounding the inner tube, a housing on the sleeve opening toward the row, a locking body in the housing displaceable into and out of engagement with a selected one of the detent recesses, an actuator rotatably mounted in the housing and bearing directly upon the body for locking the body in the selected one of the recesses in a locking position of the actuator and enabling movement of the body out of the selected one of the recesses in an unlocked position of the actuator, and a spring acting upon the actuator and biasing the actuator into the locking position.

With this system, even upon the development of high axial forces and the possible application of substantial outward radial force to the locking body in the locked position, this position will be maintained since there is no force which will tend to rotate the actuator. There is no spring or the like between the rotatable actuator and the locking body and thus the locking body is mechanically fixed in its locked position without any yieldability until the rotatable actuator is displaced. The spring acting on the rotatable member merely serves to bias the latter into the locking position and does not itself absorb any of the locking force or yield to any radial force which can result from the application of large axial forces to the inner and outer tubes.

This structure is fairly complicated. It is difficult to assemble and, due to its many parts, can come apart and fail in use.

OBJECTS OF THE INVENTION

It is therefore an object of the present invention to provide an improved latch system for a telescoping vacuum-cleaner wand.

Another object is the provision of such an improved latch system for a telescoping vacuum-cleaner wand which overcomes the above-given disadvantages, that is which is of simple and rugged construction.

SUMMARY OF THE INVENTION

A vacuum-cleaner wand has according to the invention an inner tube extending along an axis and formed with an axially extending row of radially outwardly open recesses, an outer tube engaged coaxially around the inner tube, and a latch base part fixed to the outer tube and formed with an elastically deformable web carrying a latching block displaceable radially between an inner position engageable radially in the recesses and an outer position unengageable in the recesses. The base part also is formed with a pair of radially outwardly projecting guide walls forming radially inwardly directed guide edges. A movable latch part fitting over the base part is formed with a pair of radially inwardly projecting guide walls forming radially outwardly directed guide edges sliding on the guide edges of the base part so that the movable part can slide on the base part between axially offset latched and unlatched positions. A radially inwardly projecting actuating bump formed in the movable part bears in the latched position radially inward on the block and holds the block in the inner position and is axially offset from the block in the unlatched position.

According to the invention the walls and guide edges extend axially. Thus the movable part slides axially between its positions. The edges are of barb section and the walls have outer faces extending generally radially. Furthermore the walls of the movable part engage between the walls of the base part and the base part is formed with transverse end walls extending between and bridging ends of the base-part guide walls. This structure ensures accurate guiding with a very robust connection that will have a long service life.

The movable part in accordance with the invention is generally cup shaped and fits over the base part. In addition the movable-part guide walls project from an inner surface of the movable part and the block is unitarily formed with the movable part. The actuating block is between the movable-part guide walls and the outer part forms a space into which the block can move when in the outer position.

The parts according to the invention are formed with respective abutments engaging axially against each other in the unlatched position. Furthermore a spring is braced axially between the parts and urges the movable part into the latched position. This spring is a compression spring and one of the parts is formed with a pin over which the spring is engaged and the other of the parts has an abutment against which the spring bears. Alternately the spring is U-shaped, lies generally in a plane perpendicular to the axis, has outer ends seated in the outer tube, and a bight portion coupled to the movable part. In another arrangement according to the invention a center abutment is fixed on the outer tube between a pair of springs axially oppositely engaging the center abutment. Respective end abutments formed on the movable part engage the springs to urge the movable part into the latched position. Thus the movable part is displaceable axially oppositely from the latched position into a pair of unlatched positions. Any axial movement of the outer part, in either direction, will unlatch the inner tube and allow the wand to be lengthened or shortened.

Formations on the tubes preventing relative rotation of the tubes about the axis. These formations include a radially projecting and axially extending ridge on one of the tubes and a radially open and axially extending groove on the other of the tubes. The ridge is on the base part and the groove is in the inner tube.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
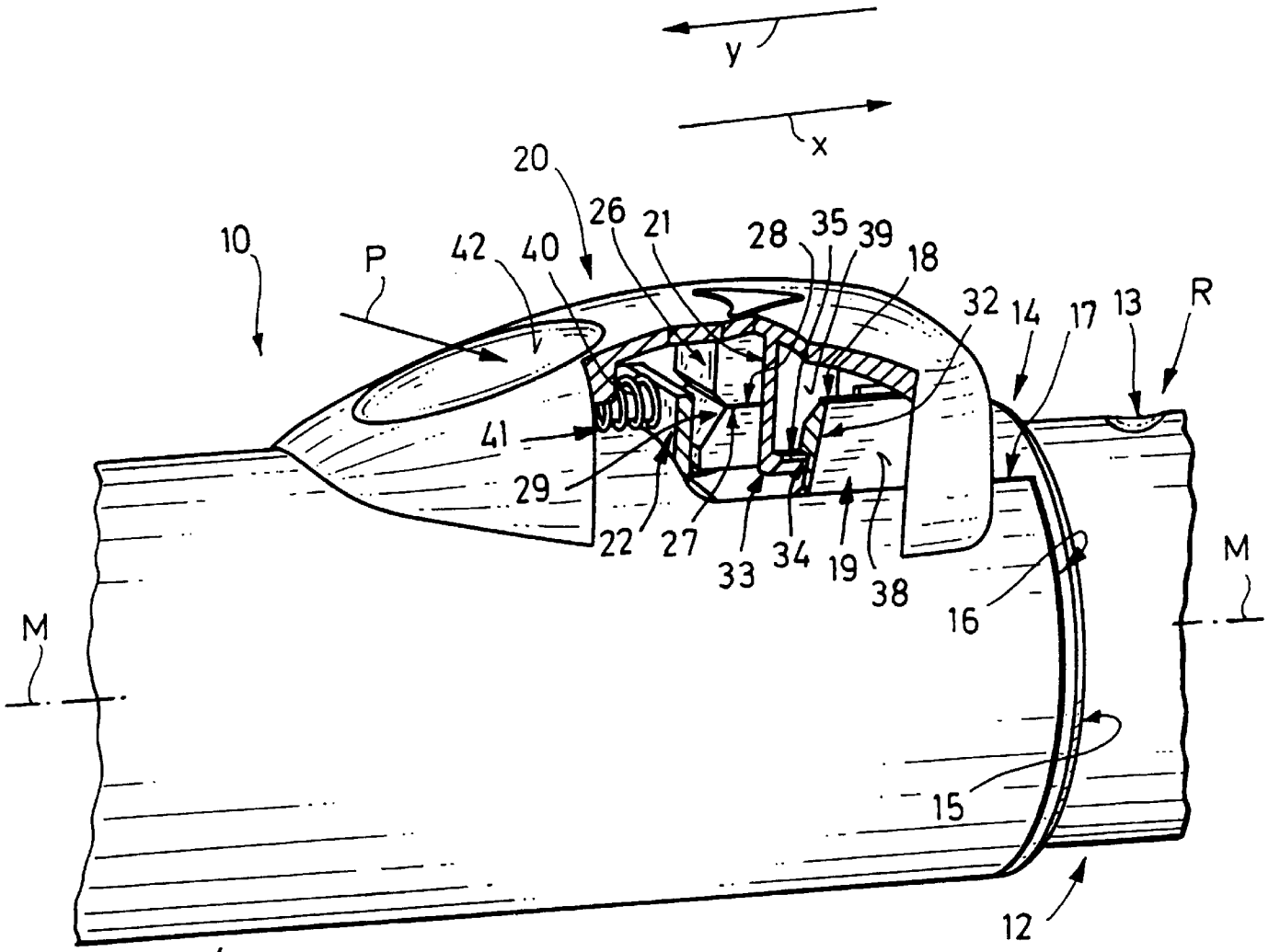
FIGS. 1 and 2 are perspective partially broken-away views of the tubes and latch according to the invention.
Figure 2:
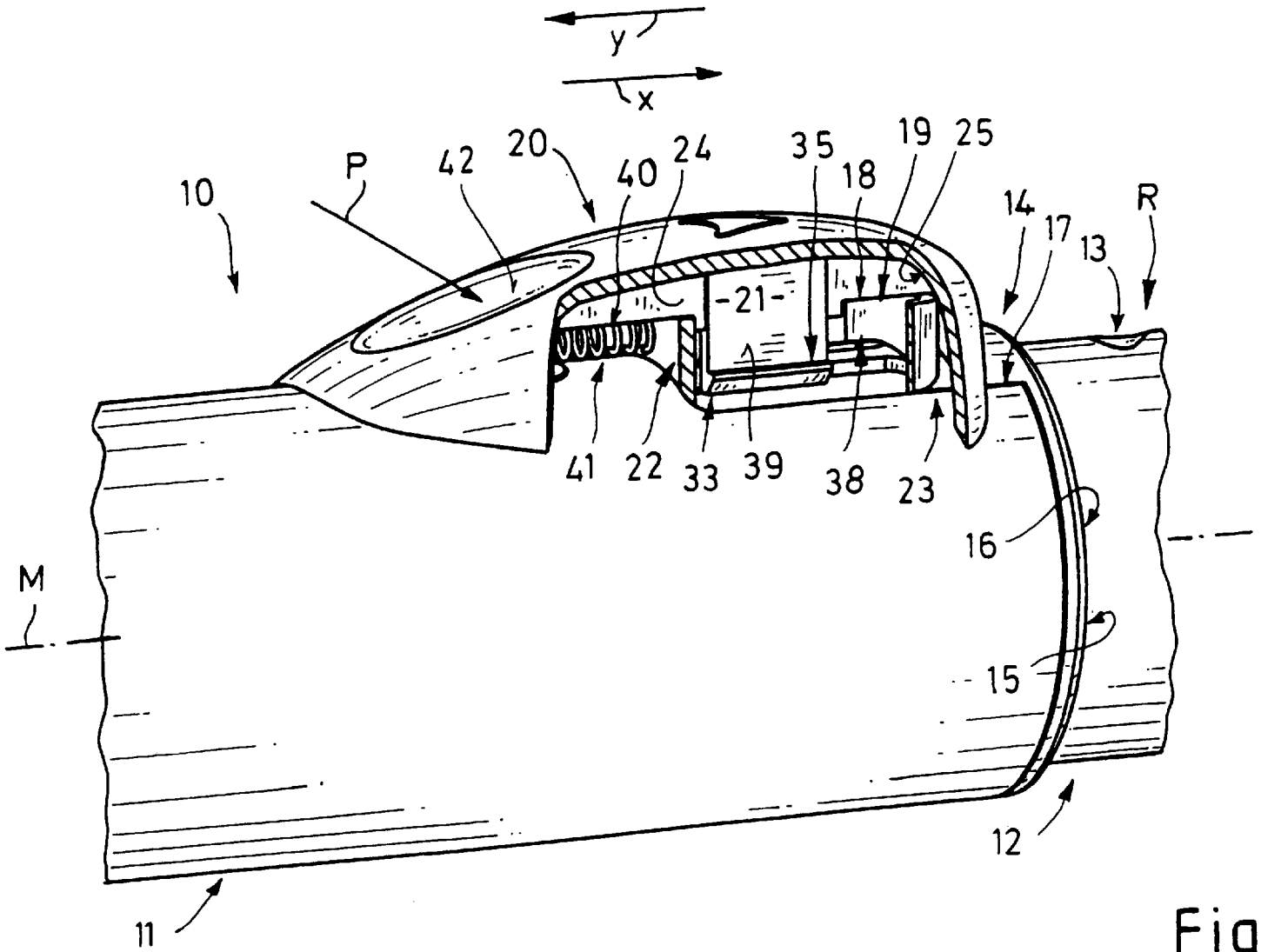
Figure 3:
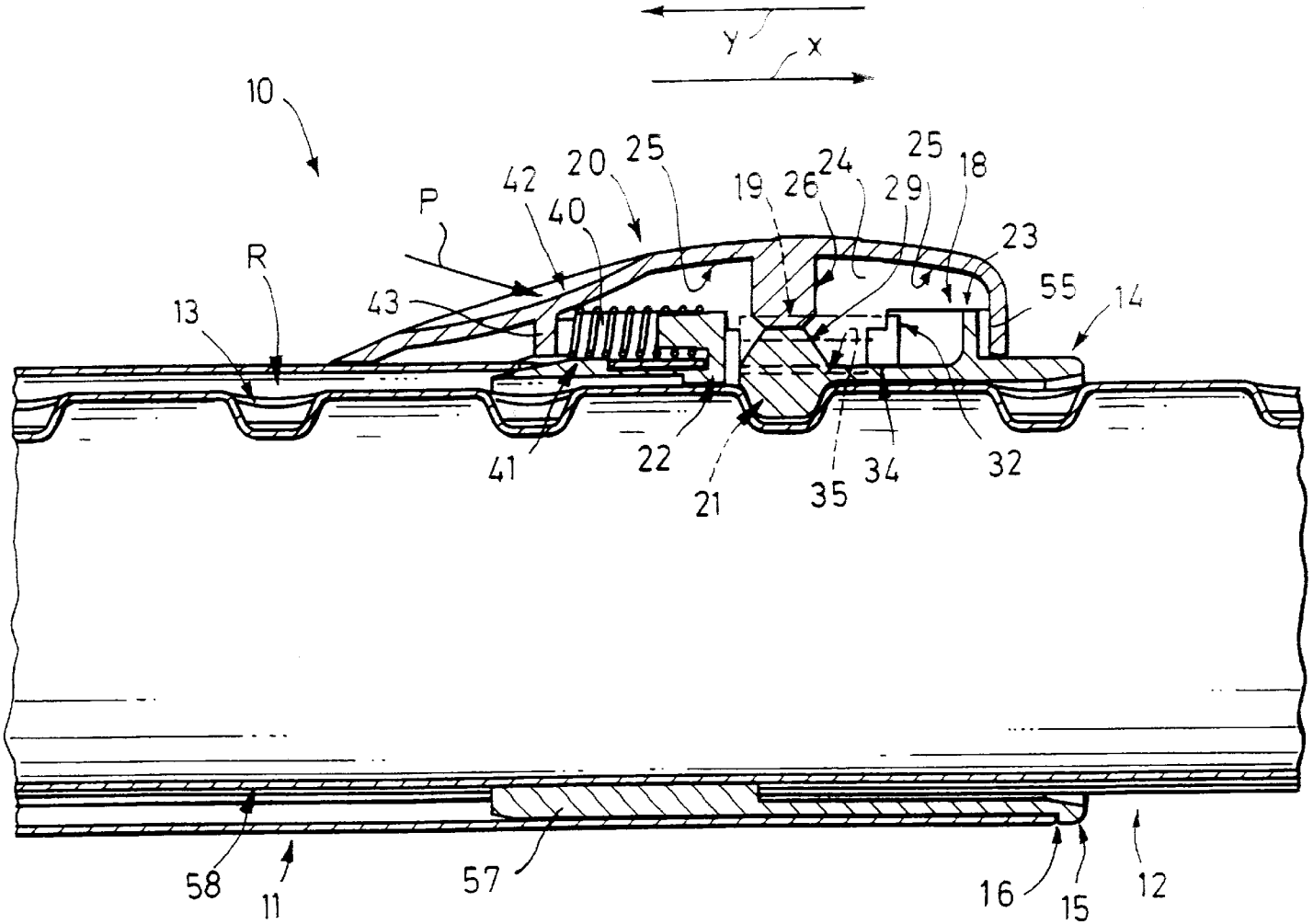
FIGS. 3, 4, and 5 are axial sections through the structure of FIGS. 1 and 2 respectively in the latched and locked, latched and unlocked, and unlatched and unlocked conditions.

As seen in FIGS. 1 through 5 a vacuum-cleaner tube or wand 10 has outer and inner normally metallic tubes 11 and 12 that fit telescopingly together coaxially of an axis M. The inner tube 12 is formed with a row R of outwardly open latch recesses or seats 13. The outer tube 11 carries a latch 14 having a plastic base body 18 extending through an axially open cutout or notch 17 in the tube 11 and having a flange 15 axially abutting an end surface 16 of the tube 11. To prevent relative rotation about the axis M of the two tubes 11 and 12, the part 18 fixed on the tube 11 has a radially inwardly projecting and axially extending rib 57 that engages in a complementary axially extending full-length groove 58 formed in the inner tube 12.

The latch body 18 has a pair of axially extending, radially outwardly projecting, and parallel walls 19 which fit with axially extending, radially inwardly projecting, and parallel walls 21 extending from an inner surface 25 of a movable plastic outer part 20. Transverse walls 22 and 23 join the ends of the walls 19 and the movable part 20 is concave and has an interior 24 into which the base part 18 fits. The base part 18 is made of an elastically deformable plastic, e.g. nylon, and is integrally formed with a latching block or element 29 having an outer face 28 engageable with an inner face 27 of an actuating bump 26 formed on the outer part 20 and projecting from its inner face 25 into the cavity 24 between the walls 21. The block 29 is supported via a flexible web 56 (FIG. 5) which allows it to be deflected radially.

The two outer-part walls 21 are formed with outwardly projecting and axially extending barb-section ribs 32 and 33 that engage under complementary inwardly projecting barb-section ribs 34 and 35 of the walls 19 so that the part 20 can slide axially freely on the part 18 that is fixed to the tube 11 but the two parts 18 and 20 cannot move radially of the axis M relative to each other. The outer ends of the walls 19 and 21 are beveled, giving the barb shape to the ribs 32, 33, 34, and 35, so that the part 20 can be snapped in place on the part 18 during assembly of the wand 10. Outer faces 38 and 39 of the walls 19 and 20 extend parallel to each other and generally radially of the axis M. In stead of the walls 21 being between the walls 19, the walls 19 could be between the walls 21.

In FIGS. 1 through 5 the transverse end wall 22 carries an axially rearwardly projecting centering pin 40 on which is carried a compression spring 41 bearing at abutment wall 43 against the part 20 to urge it axially back, that is to the left in FIGS. 1 through 5, into a position with the faces 27 and 28 aligned. In this position the latch element 29 is pressed axially backward in direction y into one of the seats 13 and the two tubes 11 and 12 are locked axially of each other. Furthermore in this position an inner face of a front wall 55 of the outer part bears against the curved front transverse end wall 23, thereby defining the latched position of the latch 14 shown in FIG. 3.

Figure 4:
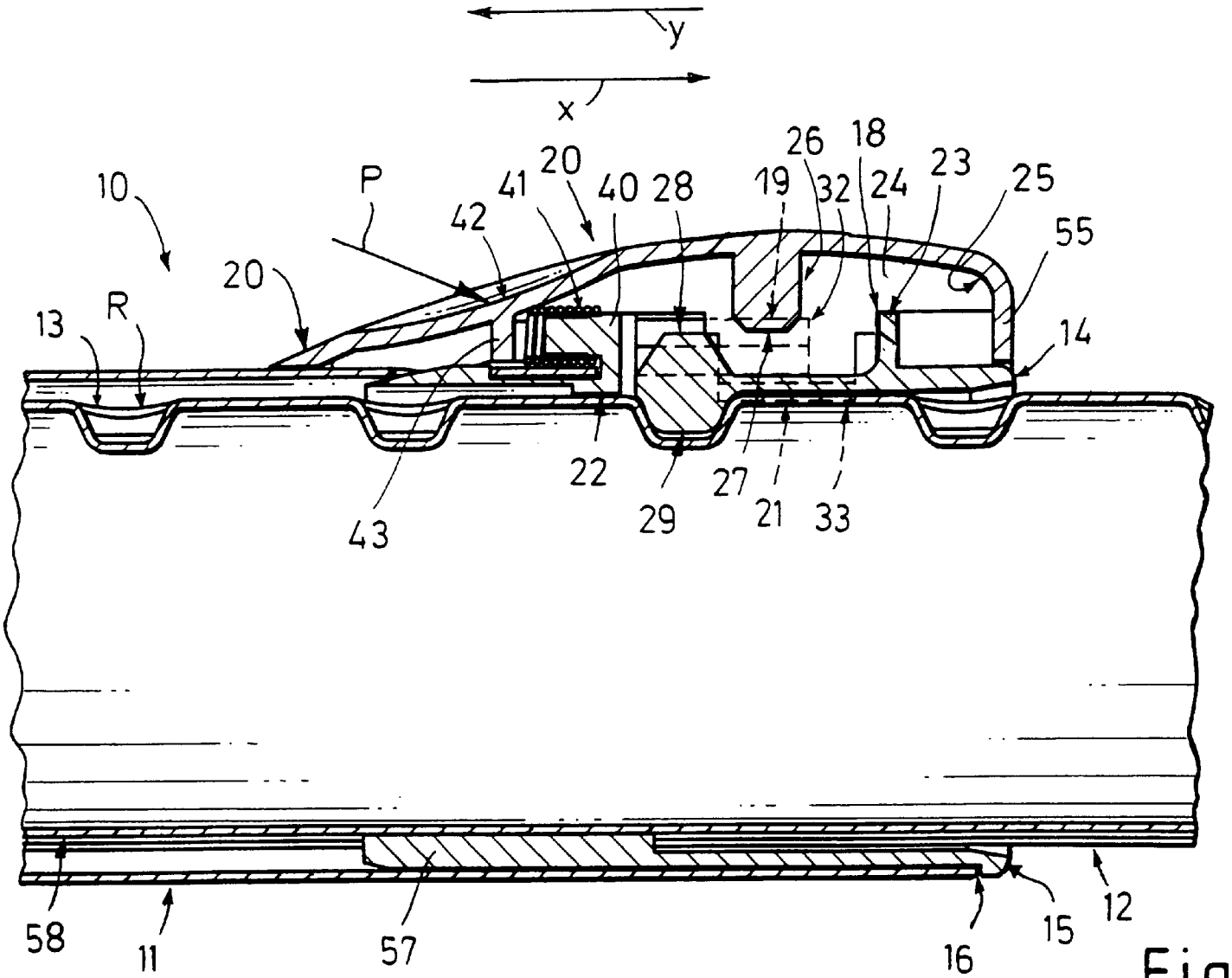
Figure 5:
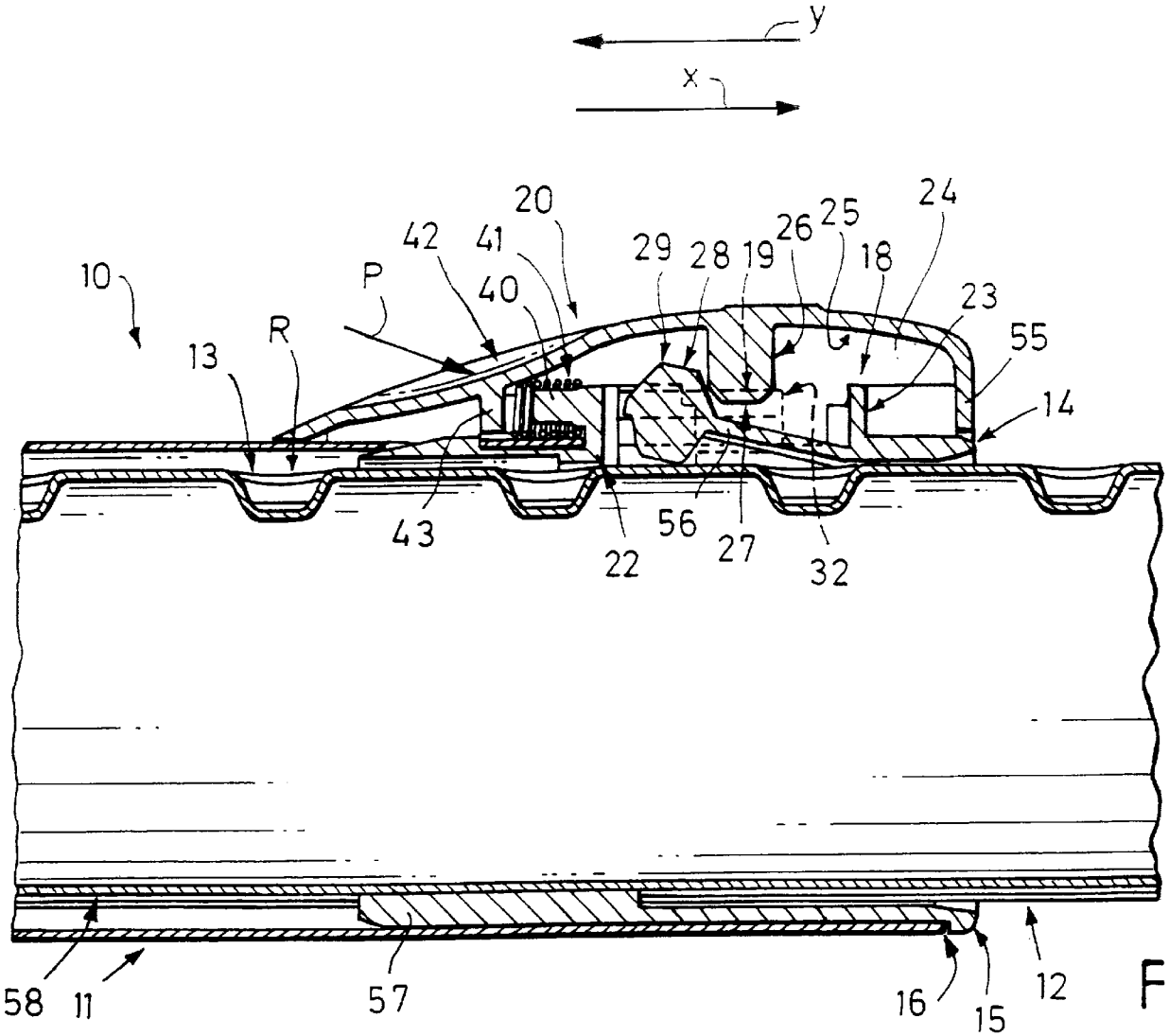

A thumb or the like can exert a force P at a finger seat 42 to shift the outer part 20 axially forward in direction x to the unlatched position of FIG. 4 in which the faces 27 and 28 no longer confront each other and the spring 41 is compressed. If the inner tube 12 is moved axially, the block 29 will be cammed outward by the inclined flanks of the seats 13 to move inward as shown in FIG. 5, allowing the two tubes 11 and 12 to be shifted axially relative to each other. In this unlatched position the latch block 29 prevents rearward movement of the outer part 20 under the force of the spring 41 by engagement of the front edge of this block 29 against the rear edge of the actuating bump 19. Only when the block 29 is urged radially inward by the elastic web 56 into one of the recesses 13 can the outer part 20 slide back to the latched position.

Figure 6:
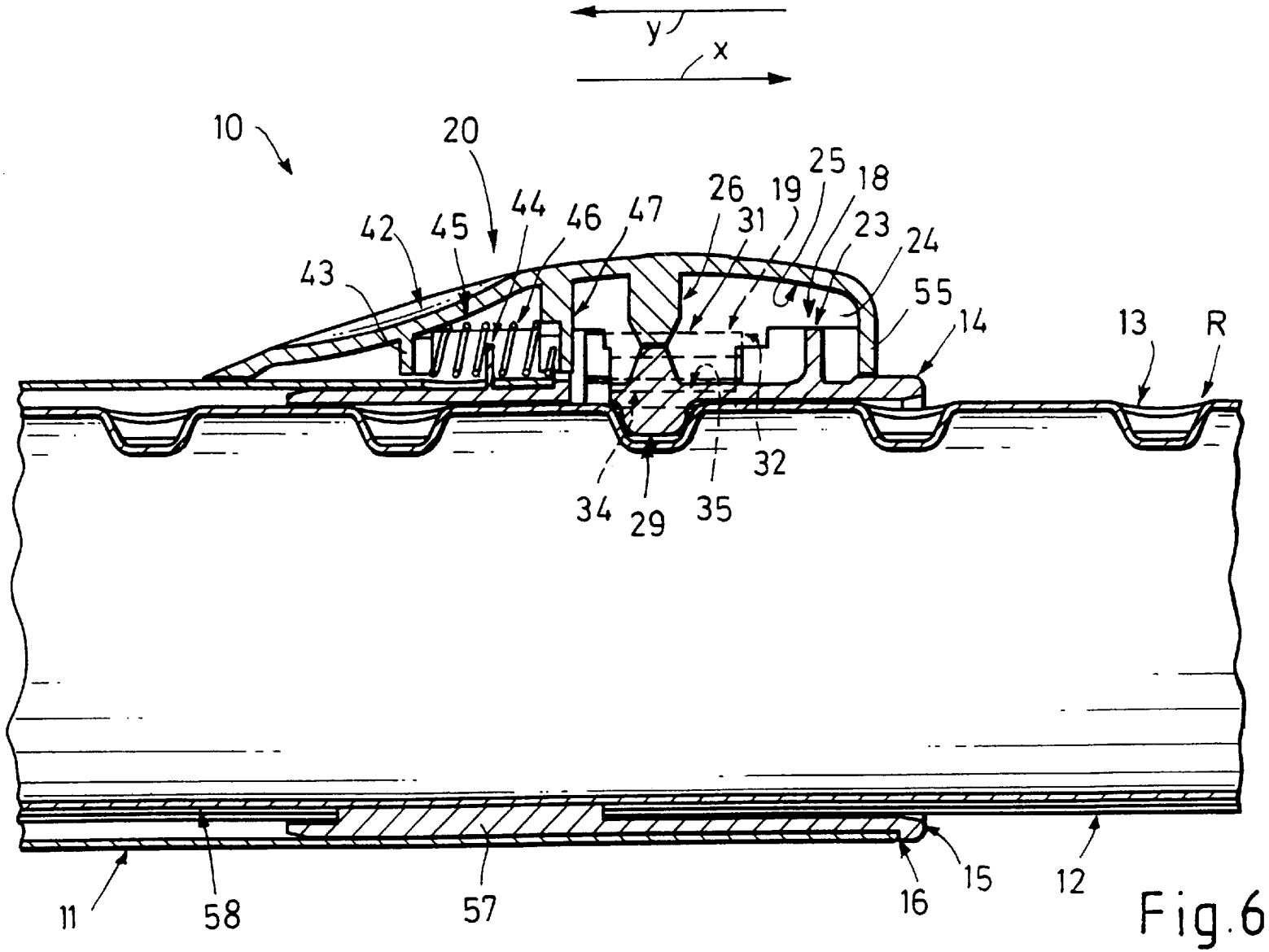
FIGS. 6, 7, and 8 are axial sections through a second embodiment in the positions of respective FIGS. 3, 4, and 5.
Figure 7:
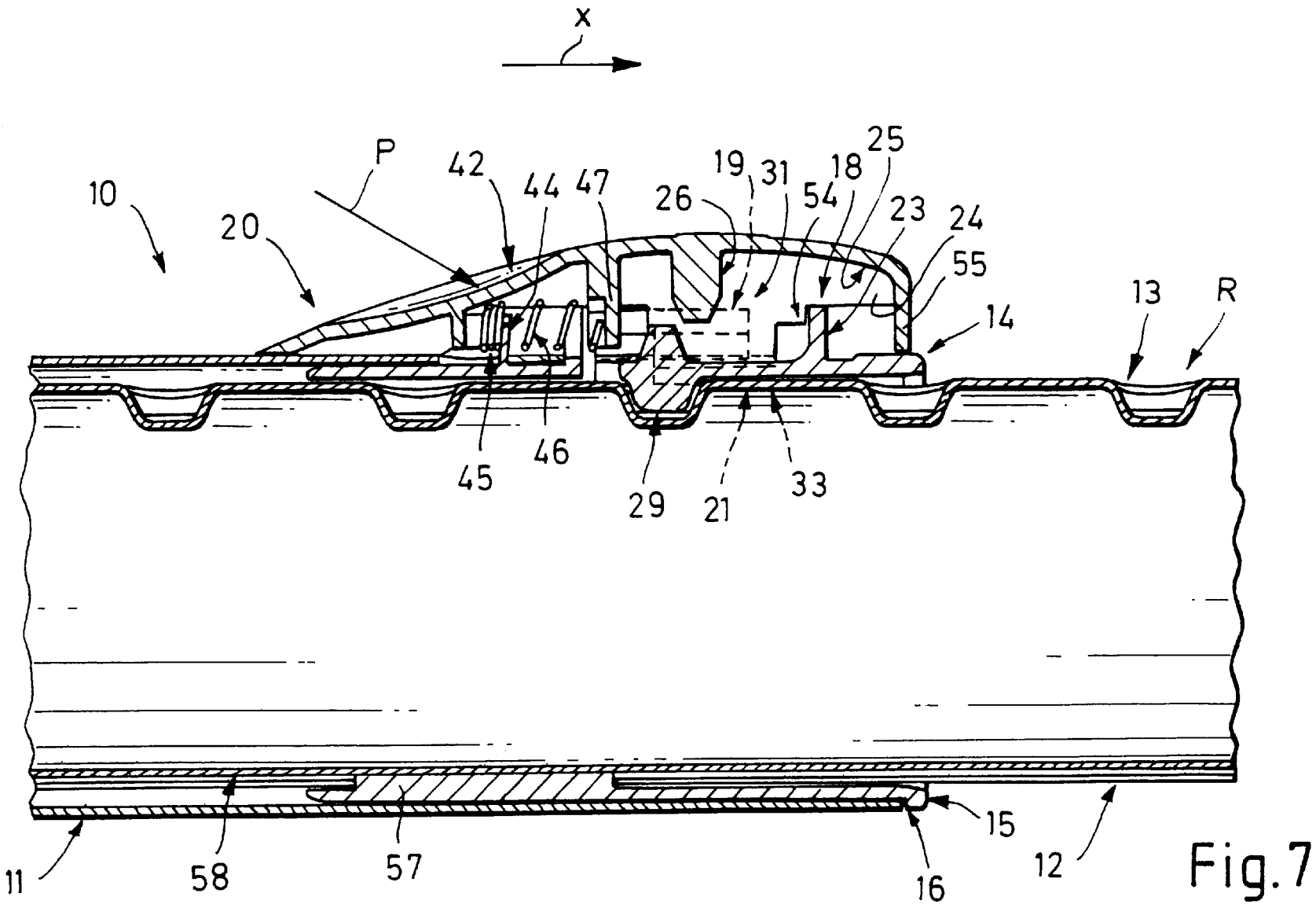
Figure 8:
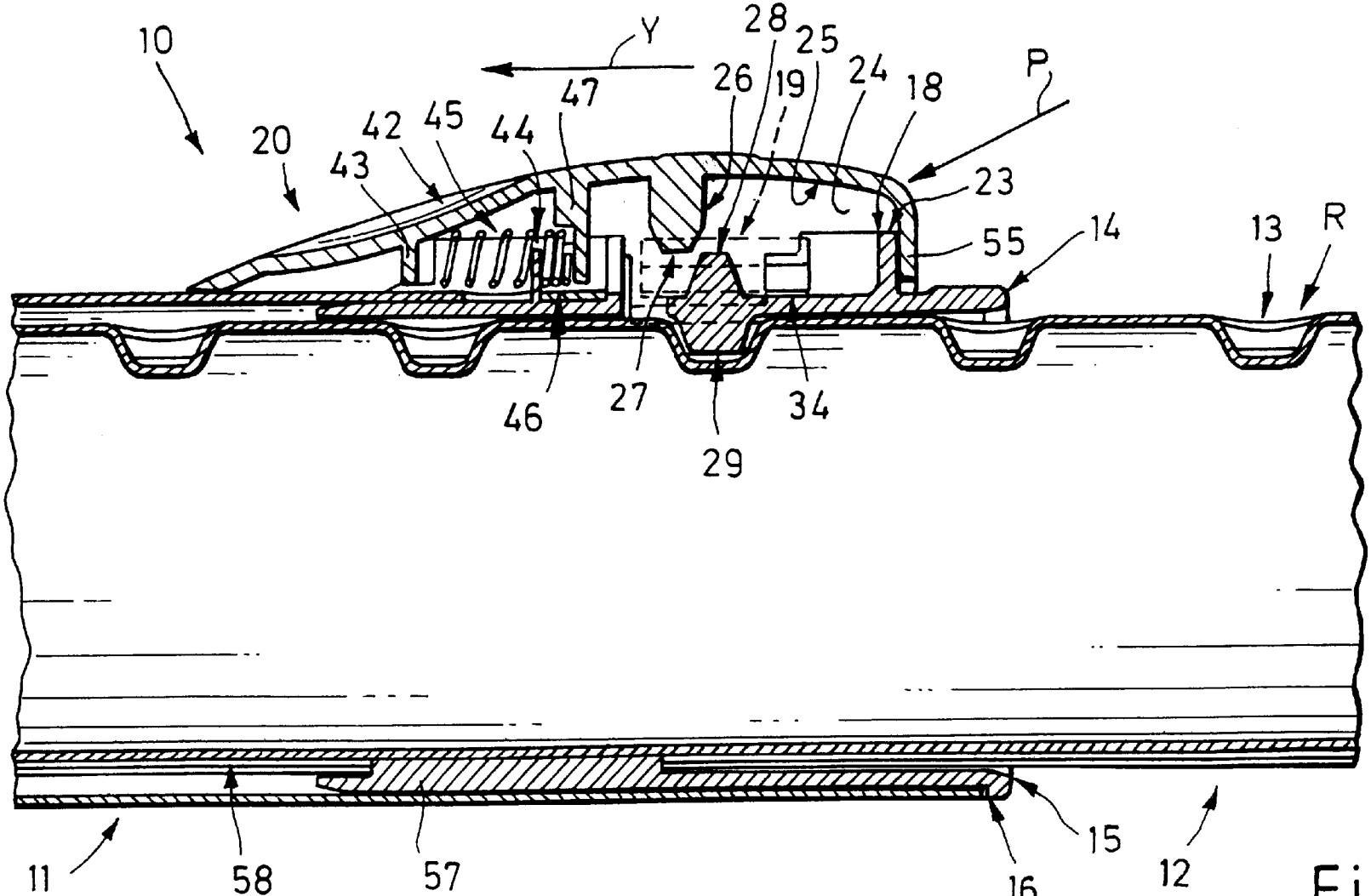

In FIGS. 6 through 8 an abutment tab 44 bent up from the outer tube 11 bears axially rearward on a compression spring 45 bearing against the abutment 43 and axially forward on a front spring 46 bearing axially forward on abutment 47 formed in the outer part 18. Thus the outer part 18 can move from the latched position in FIG. 6 in the direction x to the unlatched position of FIG. 7 or in direction y to the unlatched position of FIG. 8.

Figure 9:
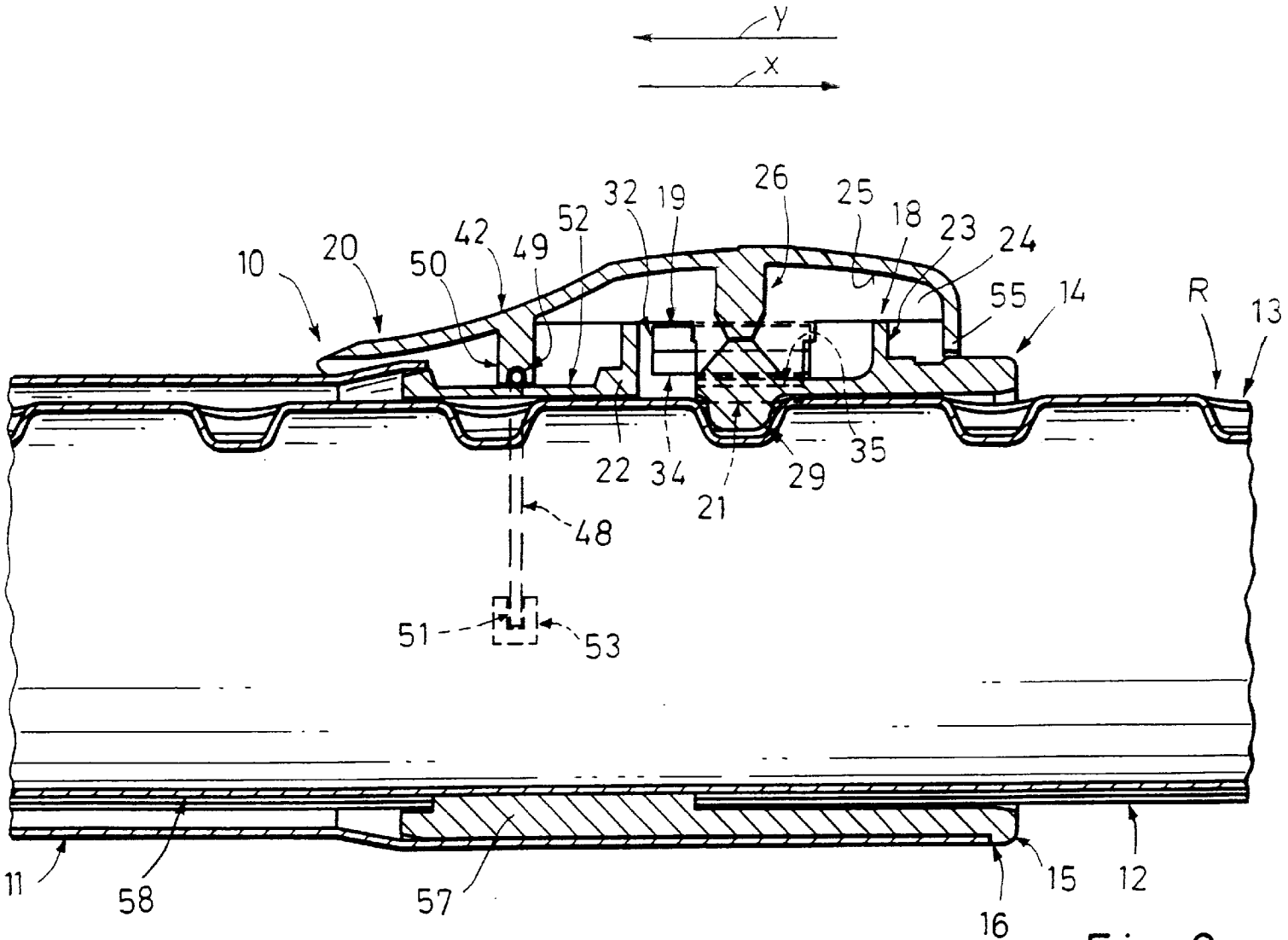
FIGS. 9, 10, and 11 are axial sections through a third embodiment in the positions of respective FIGS. 3, 4, and 5.
Figure 10:
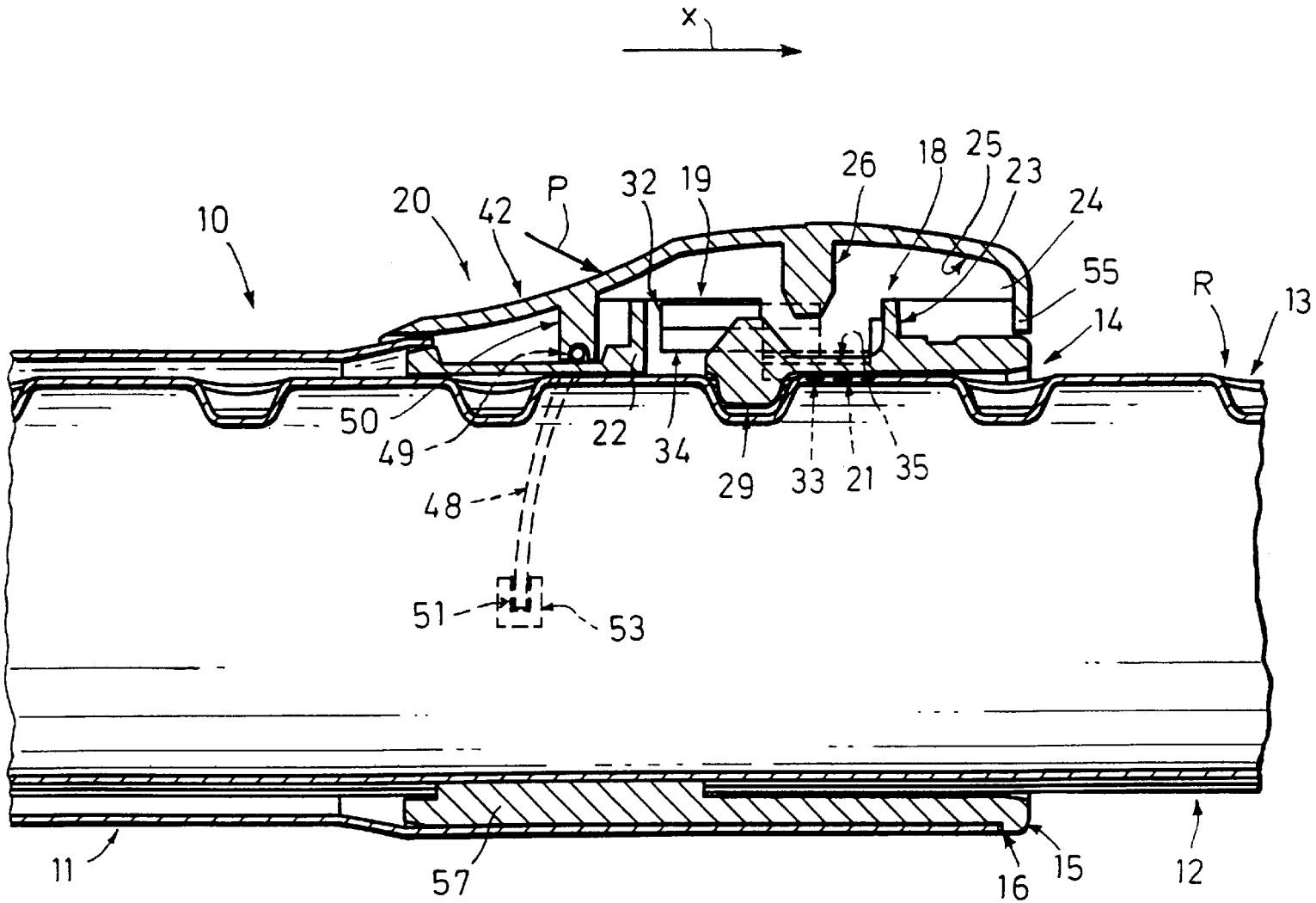
Figure 11:
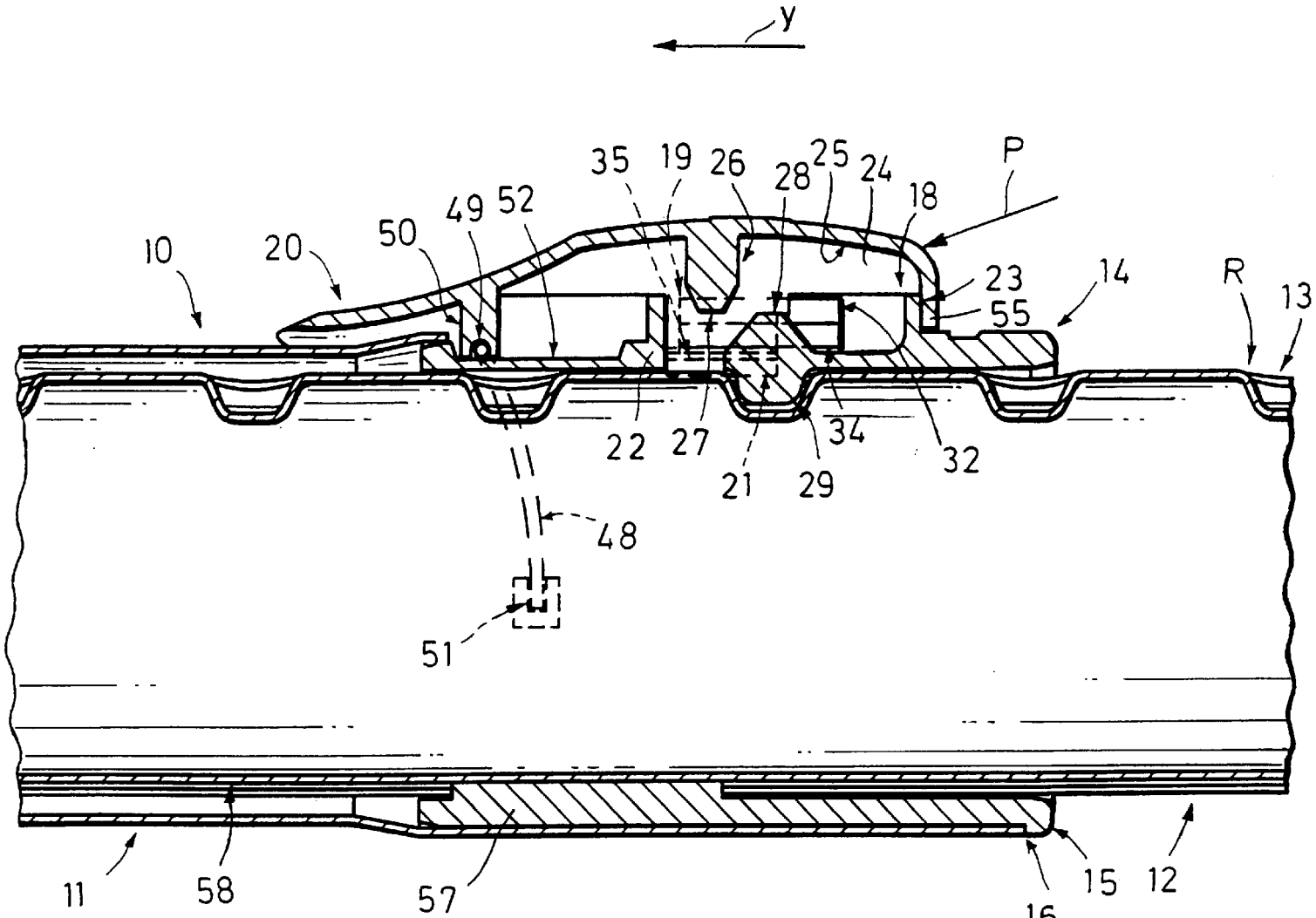

In FIGS. 9 through 11 a similar effect is achieved with a U-shaped spring 48 having ends set in seats 51 of clips 53 fixed to diametrically opposite sides of the outer tube 11 and a bight portion seated in a slot 49 of a rib 50 formed in the outer part 20 and sliding in a notch 52 of the base part 18. Thus when the outer part 20 is pushed forward in direction x as shown in FIG. 10, the spring 48 deforms forward, and when oppositely displaced as shown in FIG. 11 it is oppositely deformed.

We claim:

1. A vacuum-cleaner wand comprising:

an inner tube extending along an axis and formed with an axially extending row of radially outwardly open recesses;

an outer tube engaged coaxially around the inner tube;

a latch base part fixed to the outer tube and formed unitarily with an elastically deformable web carrying a latching block displaceable radially between an inner position engageable radially in the recesses and an outer position unengageable in the recesses, the web normally urging the block into the outer position, whereby in the inner position the tubes cannot move axially relative to each other, and a pair of limitedly elastically deflectable and radially outwardly projecting guide walls forming radially inwardly directed guide edges; and a movable latch part fitting over the base part and formed unitarily with a pair of limitedly elastically deflectable and radially inwardly projecting guide walls forming radially outwardly directed guide edges sliding on the radially inwardly directed guide edges of the base part, whereby in the outer position of the latching block the movable part can slide on the base part between axially offset latched and unlatched positions, and a radially inwardly projecting actuating bump bearing only in the latched position radially inward on the latching block and holding the block in the inner position and axially offset from and out of contact with the block in the unlatched position, whereby in the unlatched position the tubes can slide relative to each other.

2. The latchable telescoping vacuum-cleaner wand defined in claim 1 wherein the edges are of barb section.

3. The latchable telescoping vacuum-cleaner wand defined in claim 1 wherein the walls have outer faces extending generally radially.

4. The latchable telescoping vacuum-cleaner wand defined in claim 1 wherein the walls of the movable part engage between the walls of the base part.

5. The latchable telescoping vacuum-cleaner wand defined in claim 1 wherein the base part is formed with transverse end walls extending between and bridging ends of the base-part guide walls.

6. The latchable telescoping vacuum-cleaner wand defined in claim 1 wherein the movable part is generally cup shaped and fits over the base part.

7. The latchable telescoping vacuum-cleaner wand defined in claim 6 wherein the movable-part guide walls project from an inner surface of the movable part.

8. The latchable telescoping vacuum-cleaner wand defined in claim 1 wherein the block is unitarily formed with the base part.

9. The latchable telescoping vacuum-cleaner wand defined in claim 8 wherein the block is between the movable-part guide walls.

10. The latchable telescoping vacuum-cleaner wand defined in claim 1 wherein the outer part forms a space into which the block can move when in the outer position.

11. The latchable telescoping vacuum-cleaner wand defined in claim 1 wherein the parts are formed with respective abutments engaging axially against each other in the unlatched position.

12. The latchable telescoping vacuum-cleaner wand defined in claim 1, further comprising a spring braced axially between the parts and urging the movable part into the latched position.

13. The latchable telescoping vacuum-cleaner wand defined in claim 12 wherein the spring is a compression spring and one of the parts is formed with a pin over which the spring is engaged and the other of the parts has an abutment against which the spring bears.

14. The latchable telescoping vacuum-cleaner wand defined in claim 12 wherein the spring is U-shaped, lies generally in a plane perpendicular to the axis, has outer ends seated in the outer tube, and a bight portion coupled to the movable part.

15. The latchable telescoping vacuum-cleaner wand defined in claim 1, further comprising:

a center abutment fixed on the outer tube;

a pair of springs axially oppositely engaging the center abutment; and respective end abutments formed on the movable part and engaging the springs, the springs urging the movable part into the latched position, the movable part being displaceable axially oppositely from the latched position.

16. The latchable telescoping vacuum-cleaner wand defined in claim 1, further comprising means including formations on the tubes for preventing relative rotation of the tubes about the axis.

17. The latchable telescoping vacuum-cleaner wand defined in claim 16 wherein the formations include a radially projecting and axially extending ridge on one of the tubes and a radially open and axially extending groove on the other of the tubes.

18. The latchable telescoping vacuum-cleaner wand defined in claim 17 wherein the ridge is on the base part and the groove is in the inner tube.

* * * * *